US006638176B1

(12) United States Patent
Hayes et al.

(10) Patent No.: US 6,638,176 B1
(45) Date of Patent: Oct. 28, 2003

(54) SPORTS STANCE AND FOLLOW-THROUGH TRAINING APPARATUS

(76) Inventors: Cedric M. Hayes, P.O. Box 322, Transfer, PA (US) 16154; Daniel Zolnier, 2327 Downing La., Hermitage, PA (US) 16148

( * ) Notice: Subject to any disclaimer, the term of this patent is extended or adjusted under 35 U.S.C. 154(b) by 0 days.

(21) Appl. No.: 09/992,632

(22) Filed: Nov. 19, 2001

(51) Int. Cl.[7] ..... A63B 53/06; A63B 53/16; A63B 69/36; A63B 57/00; A63B 69/00

(52) U.S. Cl. ..... 473/266; 473/217; 473/452

(58) Field of Search ..... 473/217, 218, 473/266, 270, 272, 273, 452

(56) References Cited

U.S. PATENT DOCUMENTS

| | | | | | |
|---|---|---|---|---|---|
| 2,711,320 | A | * | 6/1955 | Clark | 473/270 |
| 3,342,487 | A | | 9/1967 | David | |
| 3,372,930 | A | * | 3/1968 | Sertich | 473/452 |
| 3,466,040 | A | * | 9/1969 | Sertich | 473/452 |
| 3,606,341 | A | * | 9/1971 | Honbarger | 473/217 |
| 3,815,906 | A | | 6/1974 | Hermo | |
| 4,135,668 | A | * | 1/1979 | Winkler et al. | 239/276 |
| 4,932,656 | A | | 6/1990 | Pierce | |
| 5,029,869 | A | * | 7/1991 | Veasey | 473/217 |
| 5,062,643 | A | * | 11/1991 | Bibbey et al. | 473/217 |
| 5,330,176 | A | | 7/1994 | Cagney, Jr. | |
| 5,536,004 | A | | 7/1996 | Wiseman et al. | |
| 5,665,005 | A | | 9/1997 | Ritchie | |
| 5,810,673 | A | * | 9/1998 | Castleberry | 473/217 |
| 5,830,079 | A | | 11/1998 | Hudson | |
| 5,947,833 | A | | 9/1999 | Alward | |
| 6,102,818 | A | | 8/2000 | Hamilton | |
| 6,432,001 | B1 | * | 8/2002 | Pierce | 36/127 |

* cited by examiner

*Primary Examiner*—Paul T. Sewell
*Assistant Examiner*—Alvin A. Hunter, Jr.
(74) *Attorney, Agent, or Firm*—John D. Gugliotta

(57) ABSTRACT

A sports stance and follow through training apparatus is provided having a generally elongated, planar position platform for resting parallel to the ground. A foot guard is affixed to the upper resting surface of the position platform at the front, and is formed of a flexible, elastic member forming a concave receiving cap made from a material such as SPANDEX (™). An impingement spike formed of a vertically elongated tapered shaft is pivotally affixed to the lower ground contact surface to allow said position platform to pivot about a centerline of the spike.

7 Claims, 7 Drawing Sheets

SPORTS STANCE AND FOLLOW-THROUGH TRAINING APPARATUS

RELATED APPLICATIONS

The present invention was first described in Disclosure Document Registration filed on Oct. 17, 2000 under 35 U.S.C. §122 and 37 C.F.R. §1.14, but not yet returned. There are no previously filed, nor currently any co-pending applications, anywhere in the world.

BACKGROUND OF THE INVENTION

1. Field of the Invention

The present invention relates generally to sports training devices and, more particularly, to a sports stance trainer that includes a ground stake, a durable plastic, nylon, or aluminum platform, upon which the user stands, a foot insert, into which the user inserts his/her shoe for correct positioning, VELCRO™ straps to secure the user's foot and a pivot ball turning mechanism for correct positioning of the positioning platform and shoe insert.

2. Description of the Related Art

Baseball and softball have remained popular sports throughout recent history. The pure exhilaration of stepping onto a field with your teammates, is something that many people cannot resist. However, for one to become skilled at baseball, softball or golf, many hours practice are required, especially when it comes to hitting a ball. More baseball and softball games are won and lost on hitting than almost any other factor of the game.

Accordingly much teaching and coaching time is spent on hitting, mainly using example training and other reinforcement techniques. These techniques, while useful, cannot control the player in the period of time directly before, during and after the swing. Thus, many players will lift their rear leg during the swing causing a loss of hitting power or a missed ball in the worst cases.

Numerous attempts have been made to correct for the foregoing. A search of the prior art did not disclose any patents that read directly on the claims of the instant invention; however, the following references were considered related:

The following patents disclose a stance and stride training mat with positional indicia:

U.S. Pat. No. 6,102,450 issued in the name of Hamilton

U.S. Pat. No. 5,536,004 issued in the name of Wiseman et al.

U.S. Pat. No. 4,932,656 issued in the name of Pierce

The following patents describe a stance and stride training aid including home plate reference and indicators:

U.S. Pat. No. 5,947,833 issued in the name of Alward

U.S. Pat. No. 5,330,176 issued in the name of Cagrey

U.S. Pat. No. 3,342,487 issued in the name of David

The following patents disclose an adjustable base and frame for batting stance training:

U.S. Pat. No. 5,665,005 issued in the name of Ritchie

U.S. Pat. No. 3,815,906 issued in the name of Hermo

U.S. Pat. No. 5,830,079 issued in the name of Hudson describes a swing stance and movement training apparatus for golf and other sports. Consequently, there is a need for a means by which a ball player can have their rear leg actively restrained in the hitting process in a manner which is quick, easy, effective and above all, safe for the player and coach.

SUMMARY OF THE INVENTION

It is therefore an object of the present invention to provide an improved sports stance training apparatus.

It is a feature of the present invention to provide an improved sports stance training apparatus capable of providing training as to proper stance as well as proper follow-through.

Briefly described according to one embodiment of the present invention, the present invention is an apparatus to aid in teaching baseball and softball players or golfer's the correct batting stance or swing, respectively. The invention comprises a spike that is driven into the ground where the user's back foot should be. The spike is coupled to a shoe guard or shield, into which the ballplayer would place the toe of his or her shoe. The invention rotates by use of a pivot ball joint which allows the player to turn, but not raise their rear foot. A section of stretch flex material with hook and loop fastener, such as VELCRO™ is provided to keep the player's foot in the proper position before, during and after the swing. Thus, the ballplayer can see the immediate improvement and results from a proper batting or golf stance.

The use of the present invention provides a means for anyone from little league to the professionals to improve their batting stance in a manner which is quick, easy and effective.

It is another use of the present invention to provide such a device that can also be used to improve the user's golf stance in a manner which is quick, easy and effective.

In accordance with a preferred embodiment, a teaching aid is provided that teaches and reinforces correct batting and golfing stances.

Further, the present invention works on stance training before, during and after a user's swing by helping to keep the user's back foot on the ground and in proper place.

Further, a preferred embodiment of the present invention may be applied to either sport, baseball or golf.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
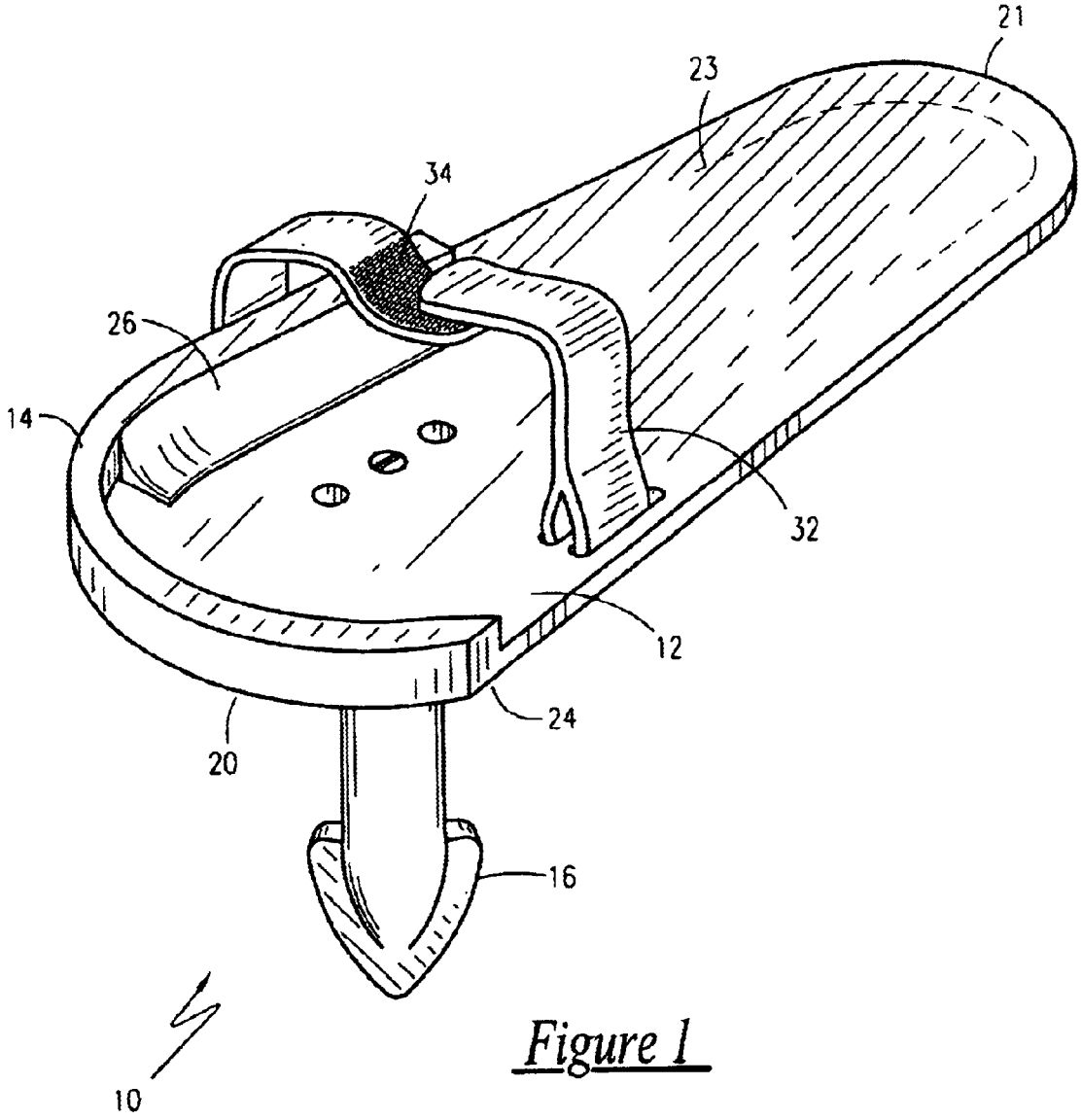
FIG. 1 is a top perspective view of sports stance and follow-through training apparatus according to the preferred embodiment of the present invention.
Figure 2:
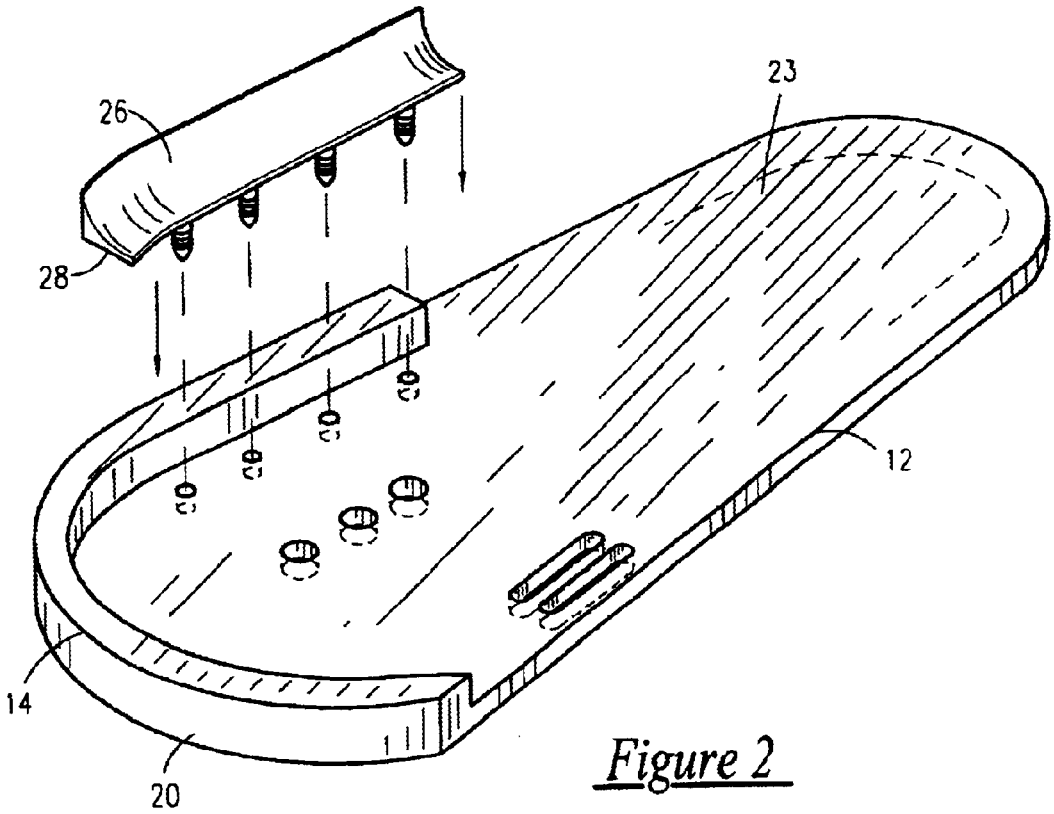
FIG. 2 is a partial exploded top perspective view thereof.
Figure 3:
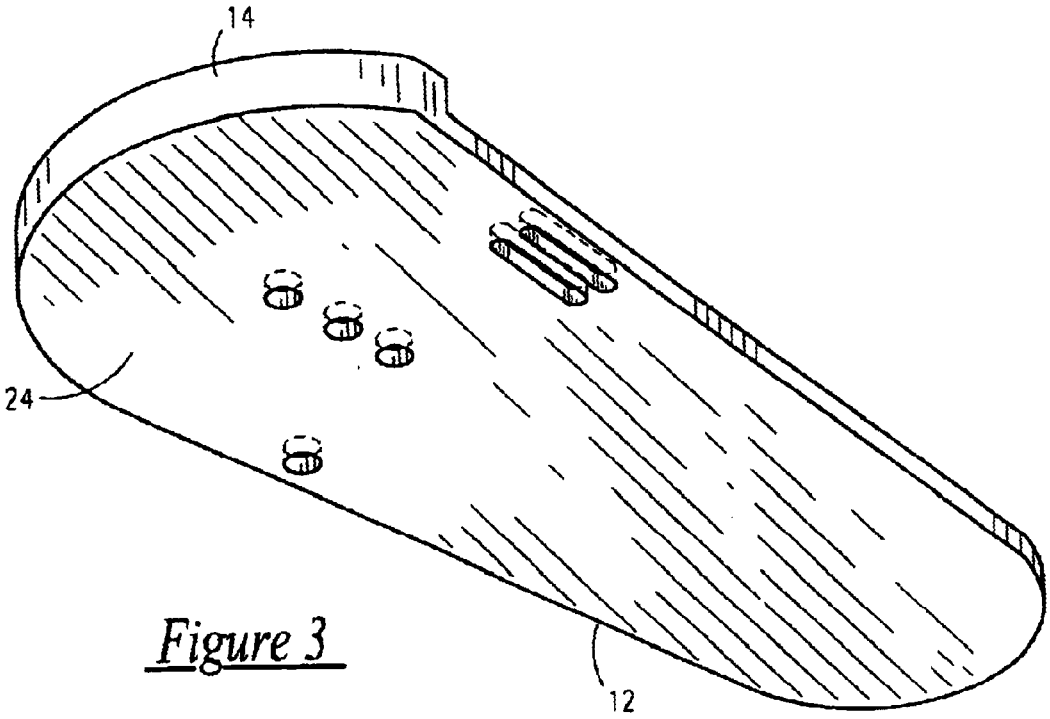
FIG. 3 is a partial bottom perspective view thereof.

In order to describe the complete relationship of the invention in a clear and concise manner, presentation of a description of one sports stance and follow-through training apparatus is shown. It is anticipated, however, that one such apparatus can be utilized in performing two distinct training functions and methods.

Therefore, the best mode for carrying out the invention is presented in terms of its preferred embodiment, herein depicted within the Figures.

DETAILED DESCRIPTION OF THE FIGURES

Referring now to FIGS. 1–6*b*, a sports stance and follow through training apparatus 10 is shown, according to the present invention, having a generally elongated, planar foot rest platform 12 supporting both a foot guard 14 and a ground impingement means 16. The foot rest platform 12 has a low profile and is anticipated as resting parallel to the ground and has a front 20 opposite a rear 21 and having an upper resting surface 23 parallel to and opposite a lower ground contact surface 24. The foot guard 14 forms a receiving lip 26 above a lower perimeter 28. The lower perimeter 28 is secured to the upper resting surface 23 about the perimeter of the front 20 of the foot rest platform 12. About the lateral outer perimeter of the foot rest platform 12 is a securement means 32, shown herein as a flexible, elongated strap terminating at one end to the foot rest platform 12 and having a hook element 34 of a hook and loop fastener for affixing to a loop element 36 affixed to the oppose lateral side of the foot rest platform 12. In this manner, the securement means 32 can temporarily secure a user's foot by circumscribing and binding the foot guard 14 to a foot placed on top of the platform 12.

Figure 4:
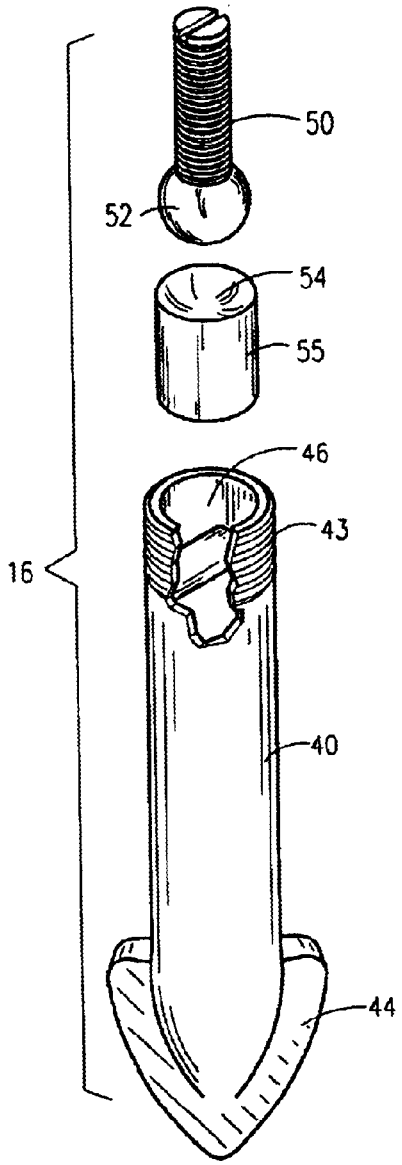
FIG. 4 is an exploded perspective view of a ground impingement means for use therewith.
Figure 5A:
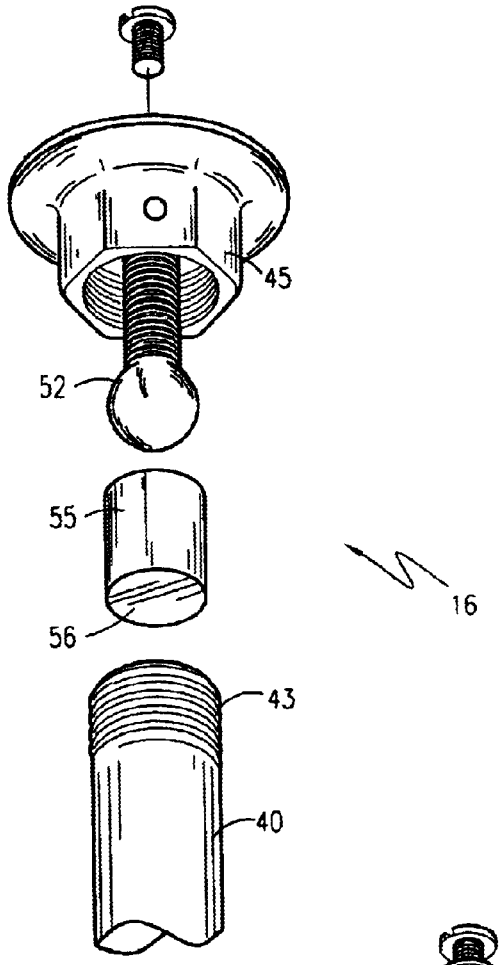
FIG. 5*a* is a partial exploded perspective of the attachment end of the ground impingement means of FIG. 4.
Figure 5B:
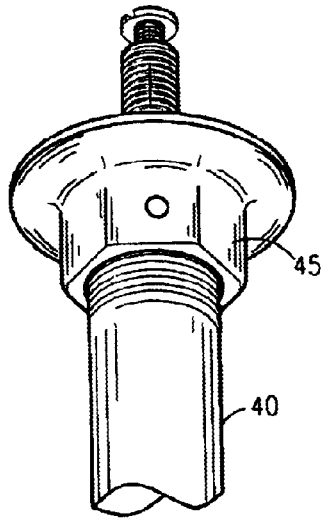
FIG. 5*b* is an assembled perspective view of FIG. 5*a;*
Figure 6A:
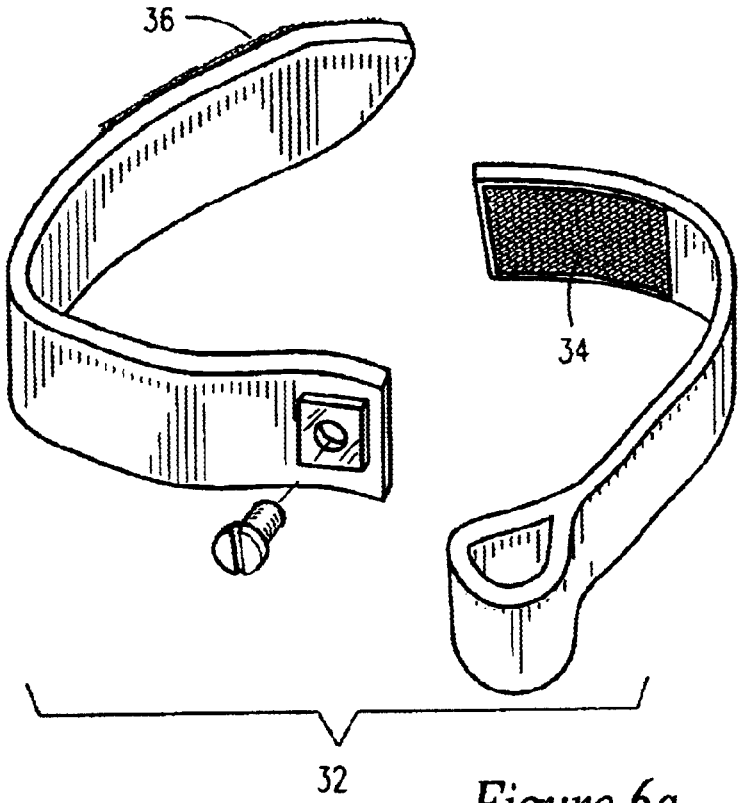
FIG. 6*a* is a top perspective view of a stretch flex strap for use with the present invention.
Figure 6B:
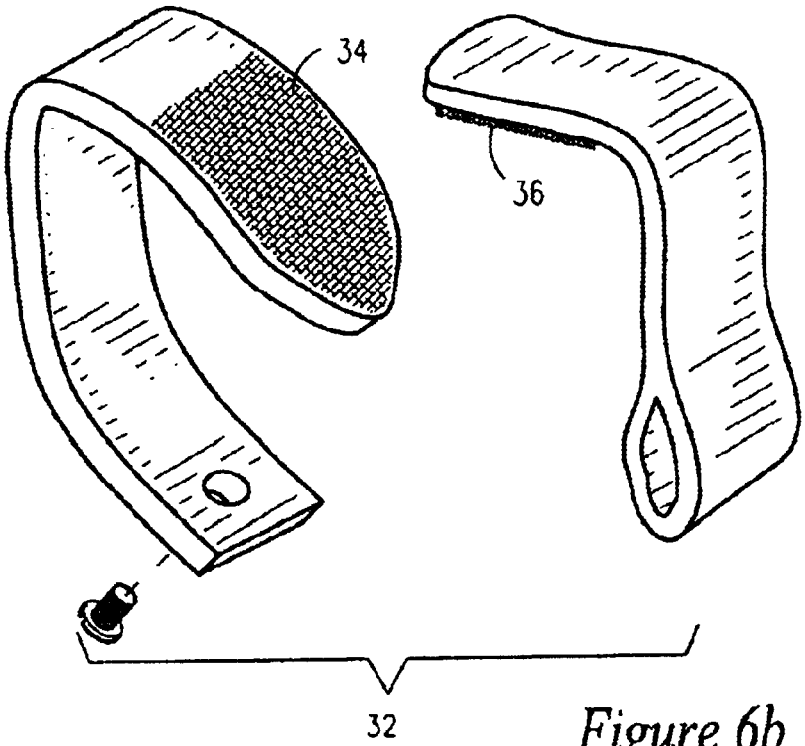
FIG. 6*b* is a reverse perspective view of FIG. 6*a;*

In conjunction with FIG. 4–5*b*, the ground impingement means 16 is shown in greater detail. In its preferred embodiment, the ground impingement means 16 comprises an impingement spike 40, a nylon socket 55, and a ball cam mechanism 42. The impingement spike 40 includes a top portion 43 opposite to a spike portion 44 and a vertically elongated shaft there between. The top portion 43 has a threaded outer circumference for threadably coupling to a threaded receiving nut 45 housed on the lower ground contact surface 24. The top portion 43 also includes an internal cavity 46 formed within the top portion 43, wherein the internal cavity 46 receives and houses the nylon socket 55.

The nylon socket 55 is a cylindrical member having a concave retention cavity 54 opposite a flat surface 56, wherein the concave retention cavity 54 receives the ball cam mechanism 42. The ball cam mechanism 42 includes a vertically elongated pivoting shaft 50 terminating in a ball cam 52. The pivoting shaft 50 inserts through the upper resting surface 23 and lower ground contact surface 24, and through the receiving nut 45. The ball cam 52 contacts and abuts against the concave retention cavity 54. The junction of the ball cam 52 and the concave retention cavity 54 allows the foot rest platform 12 to rotate 360° about a horizontal plane. The 360° of rotation allows a user, whether practicing batting or golfing, to properly rotate and align in a desired direction that might be different than previously practiced.

Figure 10:
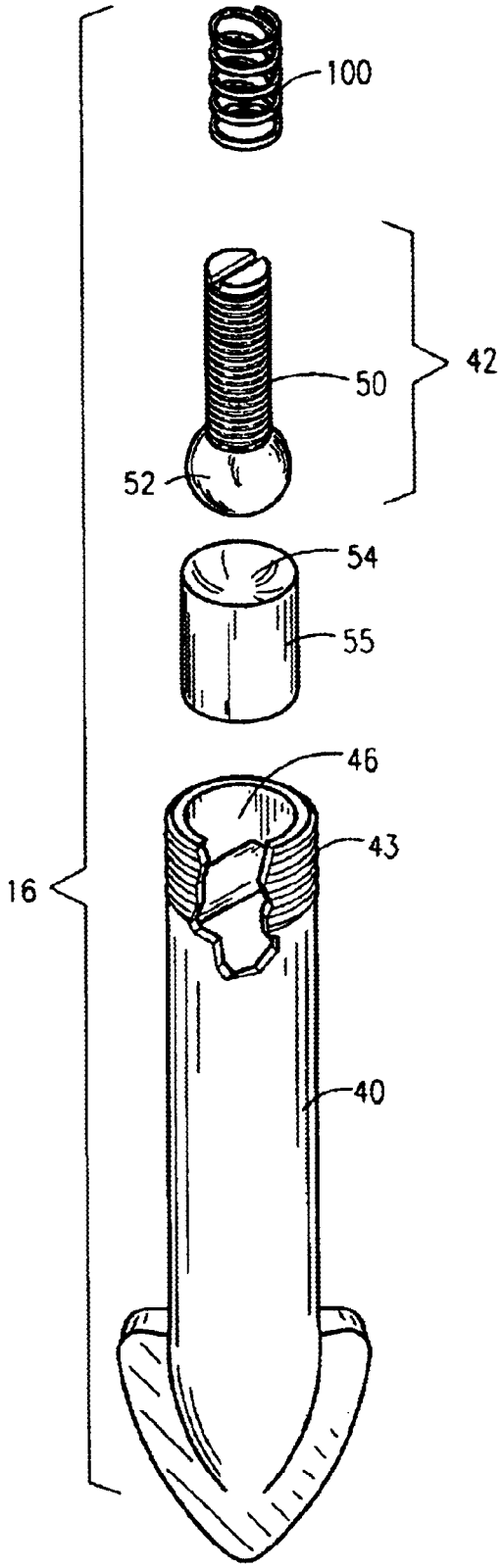
FIG. 10 is an exploded perspective view of an alternate ground impingement means for use with either embodiment of the present invention.

Referring to FIG. 10, an alternate ground impingement means 16 is shown including the addition of a flat spring member 100 that is affixed between the spike 40 and the lower surface 24 of the platform 12.

OPERATION OF THE PREFERRED EMBODIMENT

In operation, the present invention is used in conjunction with a method for training the sports stance and follow through of the user. In conjunction with such method, the user would drive the mounting spike 40 into the ground where the batter's, or golfer's back foot should be. The spike is coupled to a foot rest platform upon which the user would place his foot, with the toe of his or her shoe within the concave receiving lip 26 of the foot guard 14. A stretch flex VELCRO™ with hook and loop fastener such as VELCRO™ is provided to keep the player's foot in the proper position before, during and after the swing. By use of a pivot ball joint which allows the player to turn, but not raise their rear foot, the ballplayer can see the immediate improvement and results from a proper batting stance.

The use of the present invention provides a means for anyone from little league to the professionals to improve their batting stance in a manner which is quick, easy and effective.

Figure 7:
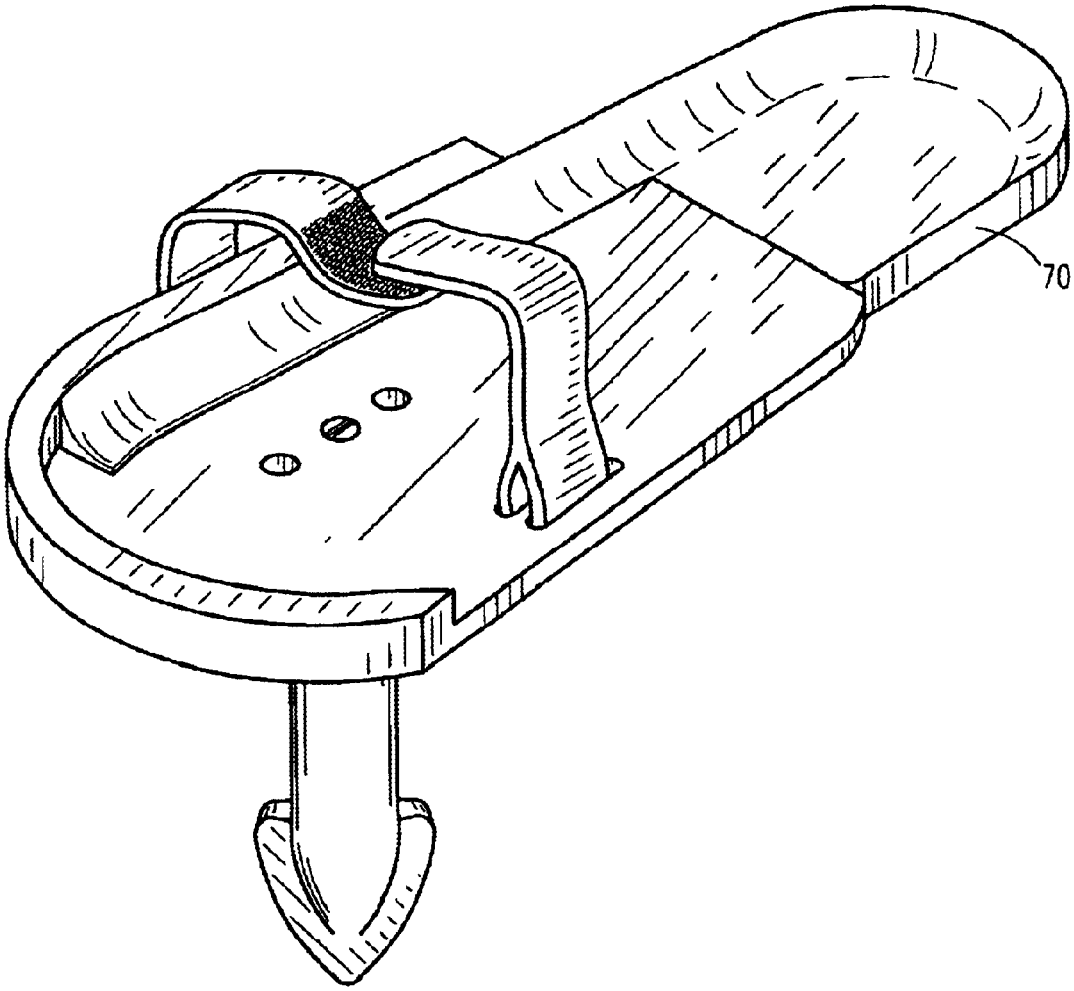
FIG. 7 is a perspective view of a sports stance and follow-through training apparatus according to a first alternate embodiment of the present invention having a detachable heel portion.
Figure 8:
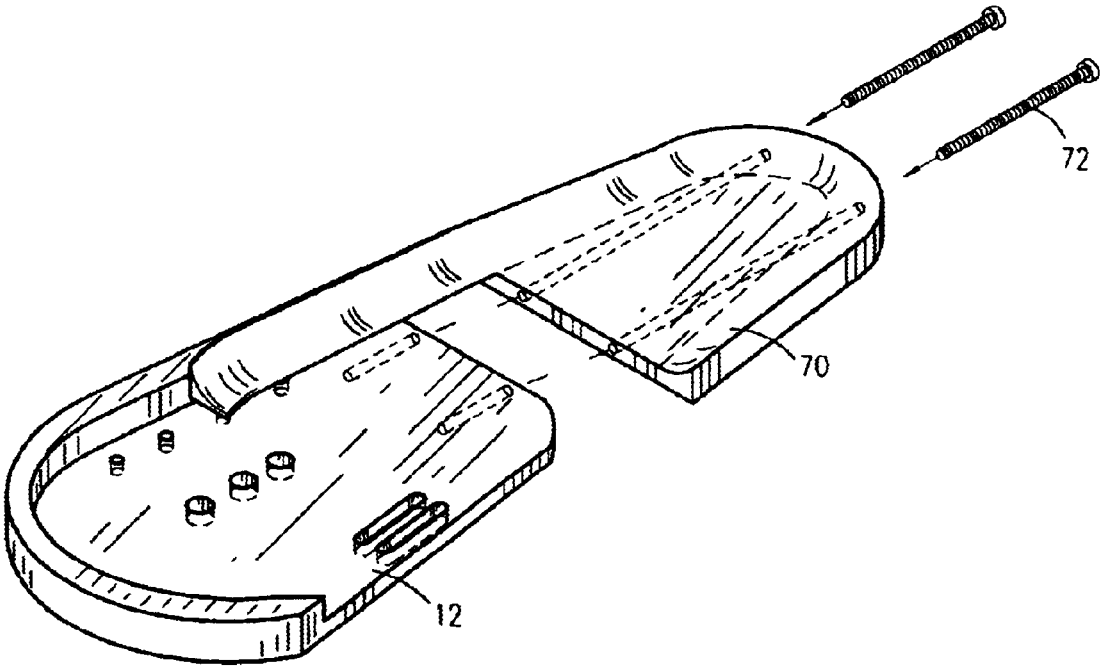
FIG. 8 is an exploded top perspective view of the embodiment of FIG. 7.
Figure 9:
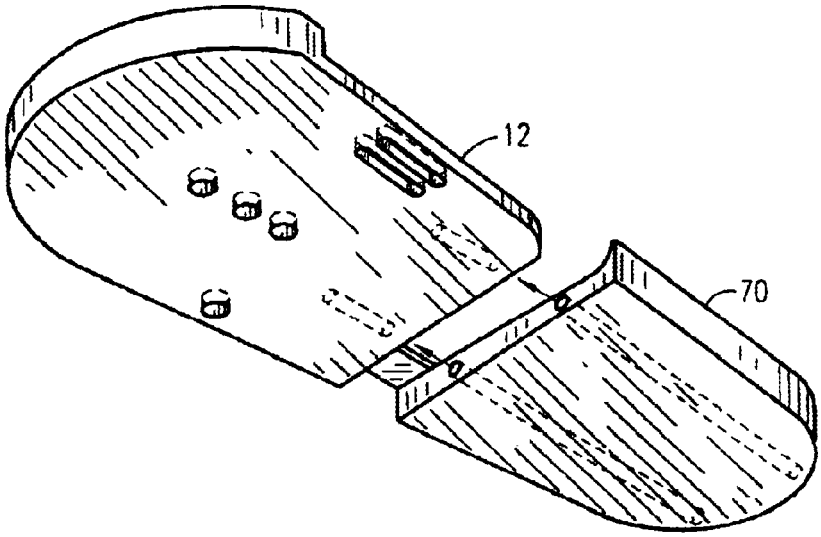
FIG. 9 is an exploded bottom perspective view of the embodiment of FIG. 7.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. By way of example, and not as a limitation, one such alternate embodiment is depicted in FIGS. 7–9, in which a removable heel portion 70 is slidably engaged with the platform 12 and affixed via threaded rods or screws 72.

Therefore, it is intended that the scope of the invention be defined by the Claims appended hereto and their equivalents. As such, the scope of the invention is to be limited only by the following claims.

What is claimed is:

1. A sports stance and follow through training apparatus comprising:

a generally elongated, planar foot rest platform, said platform having an upper resting surface opposite a lower ground contact surface;

a foot guard, said foot guard affixed to a front of said upper resting surface; and ground impingement means, said ground impingement means affixed to said lower ground contact surface through a receiving nut, said ground impingement means comprising an impingement spike, a nylon socket housed within said impingement spike, and a ball cam mechanism abutting said nylon socket, said ball cam mechanism rotatable about said nylon socket so as to allow said ground impingement means to rotate 360° about a horizontal plane.

2. The sports stance and follow through training apparatus of claim 1, wherein said foot guard is formed of a flexible, elastic member forming a retaining strap above a lower perimeter, wherein said lower perimeter is secured to said upper resting surface about a perimeter of said front of said foot rest platform.

3. The sports stance and follow through training apparatus of claim 2, wherein said foot rest platform is made from a material selected from the group consisting of plastic, nylon, and aluminum.

4. The sports stance and follow though training apparatus of claim 1, wherein an outer perimeter of said foot guard further provides an area for providing or affixing a logo indicia.

5. The sports stance and follow through training apparatus of claim 1, further comprising securement means affixed about a lateral outer perimeter of said foot rest platform.

6. The sports stance and follow through training apparatus of claim 5, wherein said securement means comprises as a flexible, elongated strap terminating at one end to the foot rest platform and having a hook element of a hook and loop fastener for affixing to a loop element affixed to an oppose lateral side of the foot rest platform such that said securement means can temporarily secure a user's foot by circumscribing and binding said foot guard to a foot placed therein.

7. The sports stance and follow through training apparatus of claim 1, wherein said pivot ball cam mechanism is formed of a pivoting shaft extending vertically upward from and attached at its lower end to a spike base that terminates the upper end of the shaft, said pivoting shaft being terminated at its upper end by a pivot ball cam which rests rotatably within a retention cavity formed within the foot rest platform.

* * * * *